US006887042B2

(12) United States Patent
Ito et al.

(10) Patent No.: US 6,887,042 B2
(45) Date of Patent: May 3, 2005

(54) BLADE STRUCTURE IN A GAS TURBINE

(75) Inventors: Eisaku Ito, Hyogo (JP); Eiji Akita, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 288 days.

(21) Appl. No.: 10/022,770

(22) Filed: Dec. 20, 2001

(65) Prior Publication Data

US 2002/0094270 A1 Jul. 18, 2002

(30) Foreign Application Priority Data

Jan. 12, 2001 (JP) ..... 2001-005724

(51) Int. Cl.[7] ..... F01D 9/02
(52) U.S. Cl. ..... 415/208.2; 415/211.2
(58) Field of Search ..... 415/191, 192, 415/193, 208.1, 208.2, 209.1, 211.2

(56) References Cited

U.S. PATENT DOCUMENTS

| | | | | |
|---|---|---|---|---|
| 4,208,167 A | | 6/1980 | Yasugahira et al. | |
| 4,714,407 A | | 12/1987 | Cox et al. | |
| 4,809,498 A | | 3/1989 | Giffin, III et al. | |
| 5,192,190 A | | 3/1993 | Ferleger et al. | |
| 5,221,181 A | * | 6/1993 | Ferleger et al. | 415/191 |
| 5,354,178 A | | 10/1994 | Ferleger et al. | |

FOREIGN PATENT DOCUMENTS

| | | | | |
|---|---|---|---|---|
| CH | 586841 | | 4/1977 | |
| DE | 2144600 | | 3/1973 | |
| DE | 196 12 394 | | 10/1997 | |
| EP | 0425889 | | 5/1991 | |
| EP | 0745755 | | 12/1996 | |
| FR | 584 884 | | 2/1925 | |
| GB | 908748 | | 10/1962 | |
| GB | 1262182 | | 12/1996 | |
| JP | 58-20903 | | 2/1983 | |
| JP | 5-222901 | | 8/1993 | |
| JP | 2710729 | | 10/1997 | |
| JP | 10-196303 | | 7/1998 | |
| JP | 10-274003 | | 10/1998 | |
| JP | 11-247615 | | 9/1999 | |
| JP | 11-336506 | | 12/1999 | |
| JP | 2000-179303 | | 6/2000 | |
| JP | 2000-257447 | | 9/2000 | |
| SU | 1605002 A | * | 11/1990 | 415/208.2 |

* cited by examiner

*Primary Examiner*—Christopher Verdier
(74) *Attorney, Agent, or Firm*—Oblon, Spivak, McClelland, Maier & Neustadt, PC

(57) ABSTRACT

In the blade structure in a gas turbine, front-edge including angles are made large. As a result, a curve of a relative relationship between incidence angles ic1 and is1 and pressure loss becomes mild. Entrance metal angles are made small. As a result, it becomes possible to make the incidence angles small. Chord length of a tip portion of a moving blade is made large. As a result, it becomes possible to make small the deceleration on a rear surface of the tip portion of the moving blade. Accordingly, it becomes possible to make the pressure loss small, and therefore, it becomes possible to improve the turbine efficiency.

2 Claims, 14 Drawing Sheets

BLADE STRUCTURE IN A GAS TURBINE

FIELD OF THE INVENTION

This invention relates to a blade structure in a gas turbine. More particularly, this invention relates to a blade structure of a gas turbine with improved turbine efficiency by restricting pressure loss to a minimum level.

BACKGROUND OF THE INVENTION

A gas turbine will be explained with reference to FIG. 16. In general, a gas turbine is equipped with a plurality of stages of stationary blades 2 and 3 arrayed in a circle on a casing (a blade circle or a vehicle chamber) 1, and a plurality of moving blades 5 arrayed in a circle on a rotor (a hub of a base) 4. FIG. 16 shows the moving blade 5 at a certain stage, the stationary blade 2 at the same stage (the inlet side of combustion gas 6) as this moving blade 5, and the stationary blade 3 at the next stage (the outlet side of the combustion gas 6) of this moving blade 5.

When pressure loss is large in the gas turbine, turbine efficiency is lowered. Therefore, it is important to improve the turbine efficiency by minimizing the pressure loss.

However, as shown in FIG. 16, there is a case where the moving blade 5 at a certain stage is what is called a free-standing moving blade that has a clearance 8 between a tip 7 of this moving blade 5 and the casing 1. In the case of this free-standing moving blade 5, there is the following problem.

Namely, as shown in FIG. 17, a main flow (shown by a solid-line arrow mark in FIG. 17) of combustion gas 6 flows to the next-stage stationary blade 3 side bypassing through between the moving blade 5 and the moving blade 5. In the mean time, in the clearance 8 between the tip 7 of the moving blade 5 and the casing 1, there is generated a leakage flow 9 (shown by a broken-line arrow mark in FIG. 17) that is separate from the main flow of the combustion gas 6.

A mechanism of generating the leakage flow 9 is that as the pressure at a belly surface 10 side of the moving blade 5 is higher than the pressure at a rear surface 11 side of the moving blade 5, the leakage flow 9 is generated from the belly surface 10 side to the rear surface 11 side based on a difference between these pressures.

As shown in FIG. 17, the leakage flow 9 flows at an incidence angle ic to the rear surface 13 side at a front edge 12 of the tip of the stationary blade 3 at the next stage. This leakage flow 9 becomes a flow opposite to the main flow of the combustion gas 6 that flows to the belly surface 14 side of the stationary blade 3.

Therefore, a vortex flow 15 (shown by a solid-line spiral arrow marking FIG. 17) is generated at the belly surface 14 side of the front edge 12 of the tip of the stationary blade 3. When this vortex flow 15 is generated, pressure loss occurs. The main flow of the combustion gas 6 may deviate from the belly surface 14 side of the stationary blade 3. In FIG. 17, a reference symbol βc denotes an entrance metal angle at the tip portion of the stationary blade 3. Similarly, a reference symbol θc denotes a front-edge including angle at the tip portion of the stationary blade 3. Similarly, a reference number 22 denotes a camber line for connecting between the front edge 12 of the tip portion of the stationary blade 3 and a rear edge 23 of the tip portion.

The incidence angle ic of the leakage flow 9 and the pressure loss have a relative relationship as shown by a solid-line curve in FIG. 18. The solid-line curve in FIG. 18 shows a case of the front-edge including angle θc at the tip portion of the stationary blade 3 shown in FIG. 17.

In this case, the front-edge including angle θc at the tip portion of the stationary blade 3 has been set such that the pressure loss becomes minimum (refer to a point P1 in FIG. 18). However, as described above, the leakage flow 9 is generated, and the pressure loss also becomes large when the incidence angle ic of this leakage flow 9 is large (refer to a point P2 in FIG. 18). When this pressure loss is large, the turbine efficiency is lowered by that amount.

Further, as shown in FIG. 16, seal-air 16 (shown by a two-dot chained line arrow mark in FIG. 16) flows from the rotor 4 side at the upstream of the moving blade 5 at a certain stage. When this seal-air 16 is flowing, there is the following problem.

Namely, the seal-air 16 simply flows out straight in a direction of the height (a radial direction of the turbine) of the moving blade 5 without being squeezed by a nozzle or the like. On the other hand, the moving blade 5 is rotating in a direction of an outline arrow mark together with the rotor 4. Therefore, from the relative relationship between the flow-out of the seal-air 16 and the rotation of the moving blade 5, the seal-air 16 flows at the incidence angle is to the rear-surface side 11 at the front edge 17 of the hub portion of the moving blade 5, as shown in FIG. 17.

As explained above, when the incidence angle is of the seal-air 16 becomes large at the front edge 17 of the hub portion of the moving blade 5 as well, the pressure loss becomes large and the turbine efficiency is lowered by that amount as shown in FIG. 17 and FIG. 18, in a similar manner to that at the front edge 12 of the tip portion of the stationary blade 3.

This problem of the hub portion of the moving blade 5 also applies to a shrouded moving blade in addition to the above-described free-standing moving blade. In FIG. 17, a reference symbol βs denotes an entrance metal angle at the hub portion of the moving blade 5. Similarly, a reference symbol θs denotes a front-edge including angle at the hub portion of the moving blade 5. Similarly, a reference number 24 denotes a camber line for connecting between the front edge 17 of the hub portion of the moving blade 5 and a rear edge 25 of the hub portion.

Further, when the moving blade 5 at a certain stage is a free-standing moving blade, there is the following problem.

Namely, as shown in FIG. 17, the leakage flow 9 is generated from the belly surface 10 side of the moving blade 5 to the rear surface 11 side, at the clearance 8 between the tip 7 of the free-standing moving blade 5 and the casing 1.

Then, as shown in FIG. 19B, a design Mach number distribution shown by a solid-line curve becomes an actual Mach number distribution as shown by a broken-line curve. As a result, on the rear surface 11 of the tip portion 18 of the moving blade 5, deceleration from an intermediate portion to a rear edge 19 is larger in actual Mach distribution G2 than in design Mach distribution G1.

When the deceleration is large, as shown in FIG. 19A, a boundary layer (a portion provided with shaded lines) 20 at a portion from the intermediate portion to the rear edge 19 swells on the rear surface 11 of the tip portion 18 of the moving blade 5. As a result, the pressure loss becomes large, and the turbine efficiency is lowered by that amount. A reference number 21 in FIG. 19 denotes a front edge of the tip portion 18 of the moving blade 5.

SUMMARY OF THE INVENTION

It is an object of this invention to provide a blade structure in a gas turbine capable of improving the turbine efficiency by minimizing the pressure loss.

In the blade structure in a gas turbine according to one aspect of this invention, a front-edge including angle at a tip portion of the stationary blade that is the stationary blade at the rear stage of the moving blade having the tip clearance is larger than a front-edge including angle at other portions than the tip portion of the stationary blade.

According to the above-mentioned aspect, a curve of a relative relationship between the incidence angle and the pressure loss becomes mild by making the front-edge including angle large. It is possible to reduce the pressure loss by that amount, and therefore, it becomes possible to improve the turbine efficiency.

In the blade structure in a gas turbine according to another aspect of this invention, an entrance metal angle at a tip portion of the stationary blade that is the stationary blade at the rear stage of the moving blade having the tip clearance is made smaller than an entrance metal angle at other portions than the tip portion of the stationary blade.

According to the above-mentioned aspect, it is possible to make the incidence angle small by making the entrance metal angle small. It is possible to reduce the pressure loss by that amount, and therefore, it becomes possible to improve the turbine efficiency.

In the blade structure in a gas turbine according to still another aspect of this invention, a front-edge including angle at a tip portion of the stationary blade that is the stationary blade at the rear stage of the moving blade having the tip clearance is made larger than a front-edge including angle at other portions than the tip portion of the stationary blade, and also an entrance metal angle at a tip portion of the stationary blade is made smaller than an entrance metal angle at other portions than the tip portion of the stationary blade.

According to the above-mentioned aspect, a curve of a relative relationship between the incidence angle and the pressure loss becomes mild by making the front-edge including angle large. It is possible to reduce the pressure loss by that amount, and therefore, it becomes possible to improve the turbine efficiency. Moreover, it is possible to make the incidence angle small by making the entrance metal angle small. Also, it is possible to reduce the pressure loss by that amount, and therefore, it becomes possible to improve the turbine efficiency. Moreover, it is possible to make the pressure loss much smaller based on a synergy effect of the work that a curve of a relative relationship between the incidence angle and the pressure loss becomes mild and the work that the incidence angle can be made small.

In the blade structure in a gas turbine according to still another aspect of this invention, a front-edge including angle at a hub portion of the stationary blade is made larger than a front-edge including angle at other portions than the hub portion of the moving blade.

According to the above-mentioned aspect, a curve of a relative relationship between the incidence angle and the pressure loss becomes mild by making the front-edge including angle large. It is possible to reduce the pressure loss by that amount, and therefore, it becomes possible to improve the turbine efficiency.

In the blade structure in a gas turbine according to still another aspect of this invention, an entrance metal angle at a hub portion of the stationary blade is made smaller than an entrance metal angle at other portions than the hub portion of the moving blade.

According to the above-mentioned aspect, it is possible to make the incidence angle small by making the entrance metal angle small. It is possible to reduce the pressure loss by that amount, and therefore, it becomes possible to improve the turbine efficiency.

In the blade structure in a gas turbine according to still another aspect of this invention, a front-edge including angle at a hub portion of the stationary blade is made larger than a front-edge including angle at other portions than the hub portion of the moving blade, and also an entrance metal angle at a hub portion of the stationary blade is made smaller than an entrance metal angle at other portions than the hub portion of the moving blade.

According to the above-mentioned aspect, a curve of a relative relationship between the incidence angle and the pressure loss becomes mild by making the front-edge including angle large. It is possible to reduce the pressure loss by that amount, and therefore, it becomes possible to improve the turbine efficiency. Moreover, it is possible to make the incidence angle small by making the entrance metal angle small. It is possible to reduce the pressure loss by that amount, and therefore, it becomes possible to improve the turbine efficiency. Furthermore, it is possible to make the pressure loss much smaller based on a synergy effect of the work that a curve of a relative relationship between the incidence angle and the pressure loss becomes mild and the work that the incidence angle can be made small.

In the blade structure in a gas turbine according to still another aspect of this invention, a chord length at a tip portion of the moving blade having the tip clearance is made larger than a minimum chord length at other portions than the tip portion of the moving blade.

According to the above-mentioned aspect, it is possible to make small the deceleration from the intermediate portion to the rear edge on the rear surface of the tip portion of the moving blade by making the chord length of the moving blade large. Then, it is possible to minimize the swelling of the boundary layer. As a result, it is possible to make the pressure loss small, and it becomes possible to improve the turbine efficiency by that amount.

Other objects and features of this invention will become apparent from the following description with reference to the accompanying drawings.

DETAILED DESCRIPTION

Embodiments of a blade structure in a gas turbine relating to this invention will be explained below with reference to the accompanying drawings. It should be noted that the blade structure in the gas turbine is not limited to these embodiments.

Figure 1:
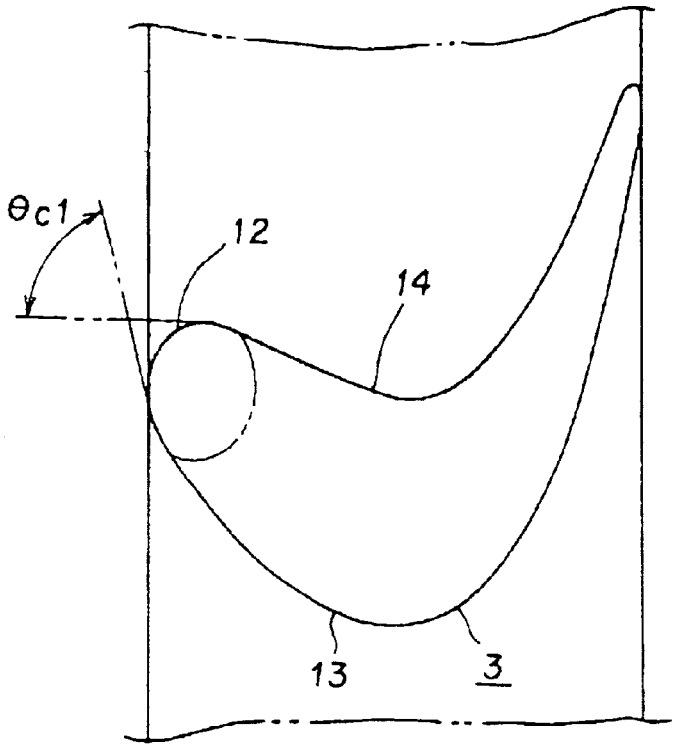
FIG. 1 is an explanatory diagram of a cross section of a tip portion of a stationary blade showing a first embodiment of a blade structure in a gas turbine according to this invention.

FIG. 1 is an explanatory diagram showing a first embodiment of a blade structure in a gas turbine relating to this invention. In the drawing, reference numbers that are the same as those in FIG. 16 to FIG. 19 show the identical portions.

A blade structure in a first embodiment relates to a stationary blade 3 at the rear stage of a moving blade having a tip clearance. A front-edge including angle θc1 at a front edge of a tip portion (a cross section of a tip) of the stationary blade 3 is made larger than a front-edge including angle of portions (across section of a hub portion to a mean portion) other than the tip portion of this stationary blade 3. For example, this is made larger than about 5°.

According to the blade structure of this first embodiment, the front-edge including angle θc1 is taken large at the tip portion of the stationary blade 3 at the rear stage of the moving blade having the tip clearance. With this arrangement, a curve of a relative relationship between the incidence angle and the pressure loss becomes mild as shown by a broken-line curve in FIG. 18. As a result, it is possible to make the pressure loss small as shown by a point P3 in FIG. 18. Therefore, it becomes possible to improve the turbine efficiency.

Figure 2:
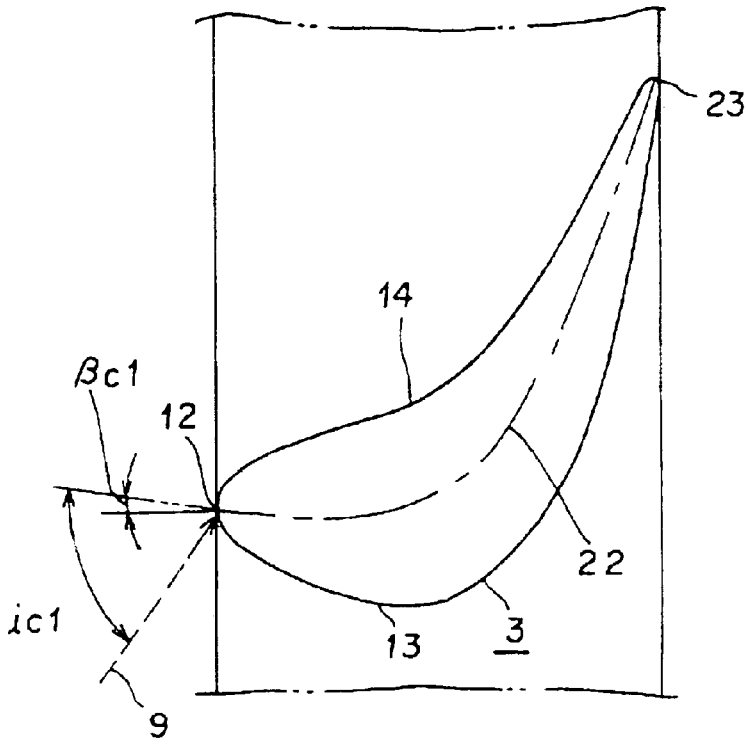
FIG. 2 is an explanatory diagram of a cross section of a tip portion of a stationary blade showing a second embodiment of a blade structure in a gas turbine according to this invention.

FIG. 2 is an explanatory diagram showing a second embodiment of a blade structure in a gas turbine relating to this invention. In the drawing, reference numbers that are the same as those in FIG. 1 and FIG. 16 to FIG. 19 show the identical portions.

A blade structure in a second embodiment relates to a stationary blade 3 at the rear stage of a moving blade having a tip clearance. An entrance metal angle βc1 of a tip portion (a cross section of a tip) of this stationary blade 3 is made smaller than an entrance metal angle of portions (a cross section of a hub portion to a mean portion) other than the tip portion of this stationary blade 3. In other words, the entrance metal angle βc1 of the cross section of the tip portion of the stationary blade 3 is directed toward a rear surface 13 side by about 10°, for example, as compared with the entrance metal angle of the cross section of the hub portion to the mean portion.

According to the blade structure of this second embodiment, the entrance metal angle βc1 is taken small at the tip portion of the stationary blade 3 at the rear stage of the moving blade having the tip clearance. With this arrangement, it is possible to make an incidence angle ic1 small as shown by a point P4 in FIG. 18. As a result, it is possible to make the pressure loss small. Therefore, it becomes possible to improve the turbine efficiency.

Figure 3:
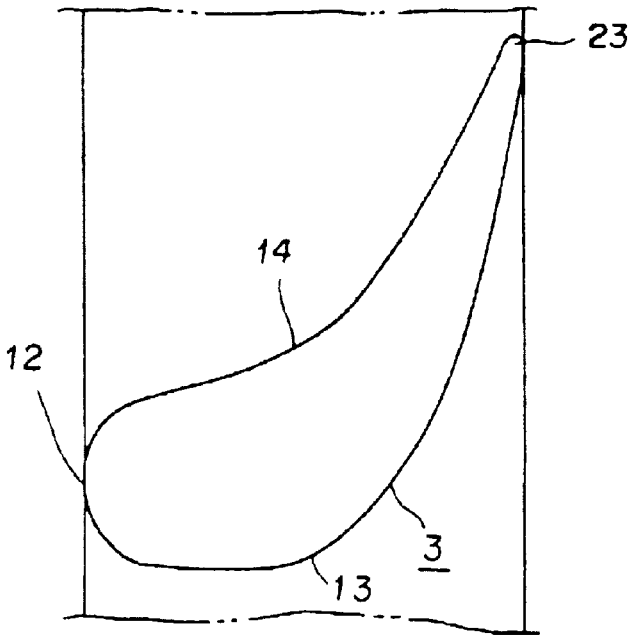
FIG. 3 is an explanatory diagram of a cross section of a tip portion of a stationary blade showing a third embodiment of a blade structure in a gas turbine according to this invention.
Figure 4:
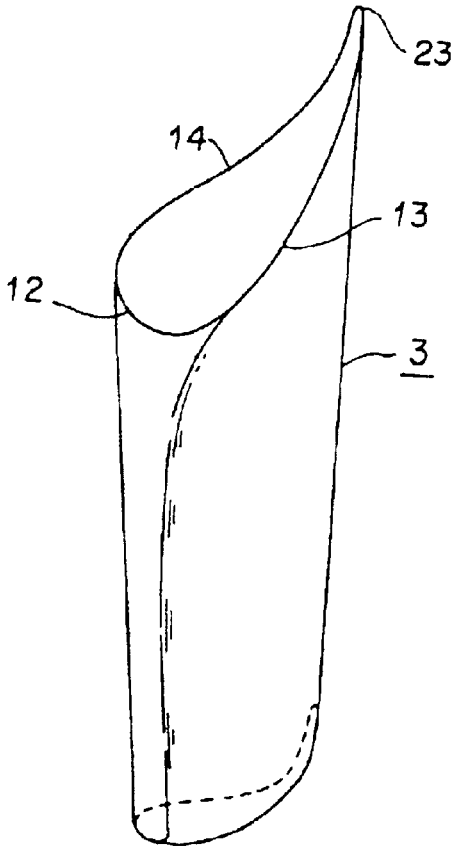
FIG. 4 is a perspective view of the stationary blade of the same.

FIG. 3 and FIG. 4 are explanatory diagrams showing a third embodiment of a blade structure in a gas turbine relating to this invention. In the drawings, reference numbers that are the same as those in FIG. 1, FIG. 2 and FIG. 16 to FIG. 19 show the identical portions.

A blade structure in a third embodiment relates to a stationary blade 3 at the rear stage of a moving blade having a tip clearance. A front-edge including angle θc1 at a front edge of a tip portion (a cross section of a tip) of the stationary blade 3 is made larger than a front-edge including angle of portions (a cross section of a hub portion to a mean portion) other than the tip portion of this stationary blade 3. For example, this is made larger than about 5°.

Further, an entrance metal angle βc1 of a tip portion (a cross section of a tip) of this stationary blade 3 is made smaller than an entrance metal angle of portions (a cross section of a hub portion to a mean portion) other than the tip portion of this stationary blade 3. In other words, the entrance metal angle βc1 of the cross section of the tip portion of the stationary blade 3 is directed toward a rear surface 13 side by about 10°, for example, as compared with the entrance metal angle of the cross section of the hub portion to the mean portion.

According to the blade structure of this third embodiment, the front-edge including angle θc1 is taken large at the tip portion of the stationary blade 3 at the rear stage of the moving blade having the tip clearance. With this arrangement, a curve of a relative relationship between the incidence angle and the pressure loss becomes mild as shown by the broken-line curve in FIG. 18. As a result, it is possible to make the pressure loss small as shown by the point P3 in FIG. 18. Therefore, it becomes possible to improve the turbine efficiency.

Further, according to the blade structure of this third embodiment, the entrance metal angle βc1 is taken small at the tip portion of the stationary blade 3 at the rear stage of the moving blade having the tip clearance. With this arrangement, it is possible to make an incidence angle ic1 small as shown by the point P4 in FIG. 18. As a result, it is possible to make the pressure loss small. Therefore, it becomes possible to improve the turbine efficiency.

Figure 18:
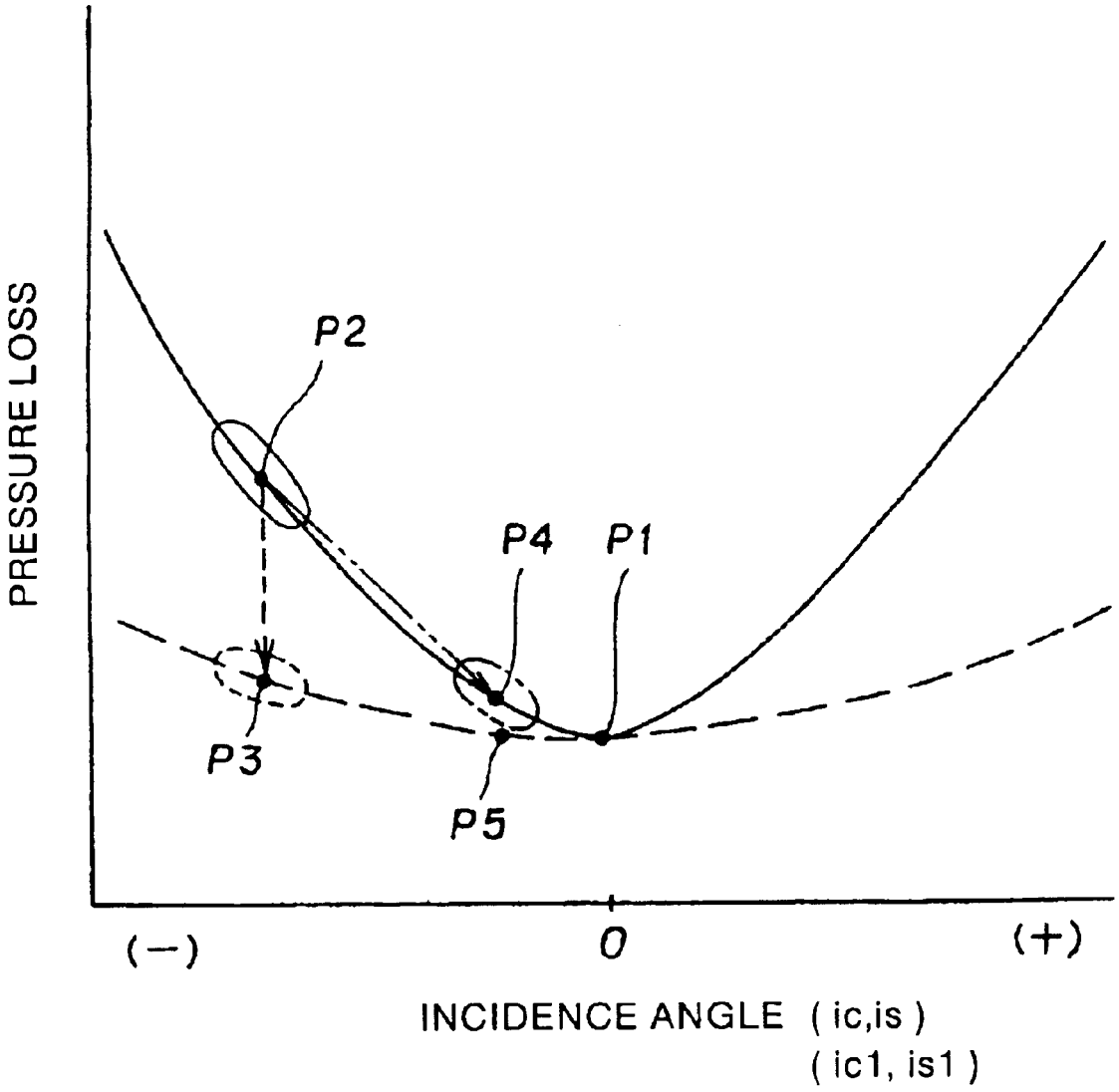
FIG. 18 is an explanatory diagram showing a relative relationship between an incidence angle and a pressure loss.

Particularly, according to the blade structure of this third embodiment, it is possible to make the pressure loss much smaller, based on a synergy effect of the work that a curve of a relative relationship between the incidence angle and the pressure loss becomes mild as shown by the broken-line curve in FIG. 18 and the work that the incidence angle ic1 can be made small as shown by a point P5 in FIG. 18. As a result, it becomes possible to improve the turbine efficiency.

Figure 5:
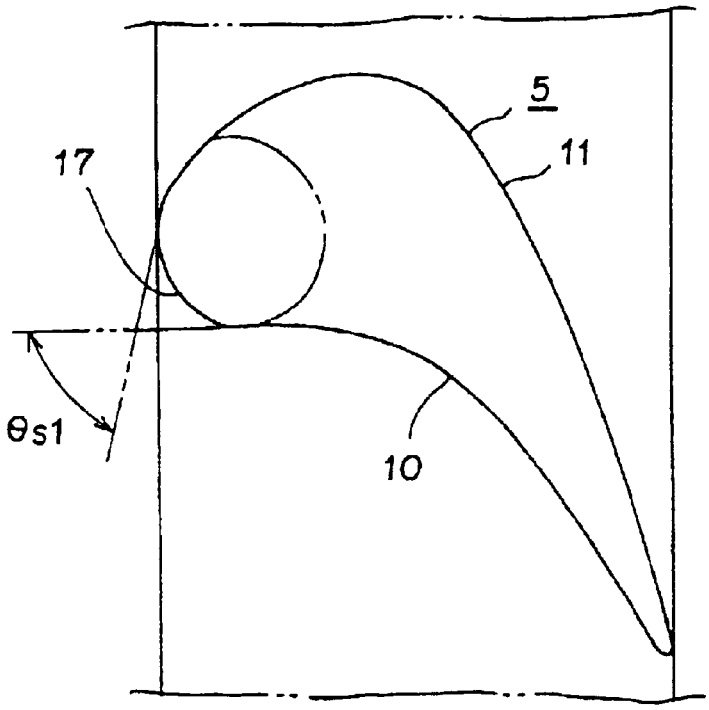
FIG. 5 is an explanatory diagram of a cross section of a hub portion of a moving blade showing a fourth embodiment of a blade structure in a gas turbine according to this invention.

FIG. 5 is an explanatory diagram showing a first embodiment of a blade structure in a gas turbine relating to this invention. In the drawing, reference numbers that are the same as those in FIG. 1 to FIG. 4 and FIG. 16 to FIG. 19 show the identical portions.

A blade structure in a fourth embodiment relates to a moving blade 5 like a free-standing moving blade and a shrouded moving blade. A front-edge including angle θs1 at a hub portion (a cross section of a hub portion) of this moving blade 5 is made larger than a front-edge including angle of portions (a cross section of a tip portion to a mean portion) other than the hub portion of this moving blade 5. For example, this is made larger than about 5°.

According to the blade structure of this fourth embodiment, the front-edge including angle θs1 is taken large at the hub portion of this moving blade 5. With this arrangement, a curve of a relative relationship between the incidence angle and the pressure loss becomes mild as shown by the broken-line curve in FIG. 18. As a result, it is possible to make the pressure loss small as shown by the point P3 in FIG. 18. Therefore, it becomes possible to improve the turbine efficiency.

Figure 6:
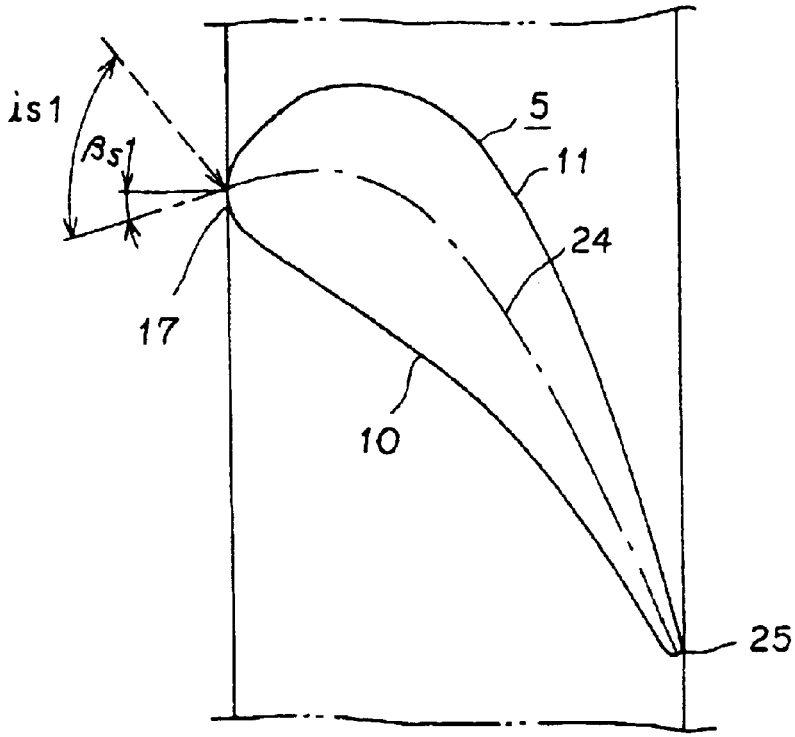
FIG. 6 is an explanatory diagram of a cross section of a hub portion of a moving blade showing a fifth embodiment of a blade structure in a gas turbine according to this invention.

FIG. 6 is an explanatory diagram showing a fifth embodiment of a blade structure in a gas turbine relating to this invention. In the drawing, reference numbers that are the same as those in FIG. 1 to FIG. 5 and FIG. 16 to FIG. 19 show the identical portions.

A blade structure in a fifth embodiment relates to a moving blade 5 like a free-standing moving blade and a shrouded moving blade. An entrance metal angle βs1 of a hub portion (a cross section of a hub portion) of this moving blade 5 is made smaller than an entrance metal angle of portions (a cross section of a tip portion to a mean portion) other than the hub portion of this moving blade 5. In other words, the entrance metal angle βs1 of the cross section of the hub portion of the moving blade 5 is directed toward a rear surface 11 side by about 10°, for example, as compared with the entrance metal angle of the cross section of the tip portion to the mean portion.

According to the blade structure of this fifth embodiment, the entrance metal angle βs1 is taken small at the hub portion of the moving blade 5. With this arrangement, it is possible to make an incidence angle is1 small as shown by the point P4 in FIG. 18. As a result, it is possible to make the pressure loss small. Therefore, it becomes possible to improve the turbine efficiency.

Figure 7:
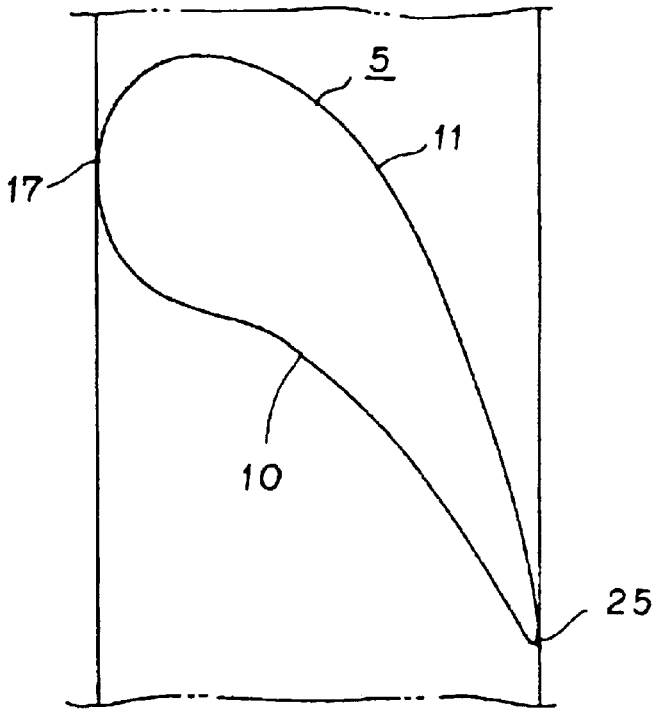
FIG. 7 is an explanatory diagram of a cross section of a hub portion of a moving blade showing a sixth embodiment of a blade structure in a gas turbine according to this invention.
Figure 8:
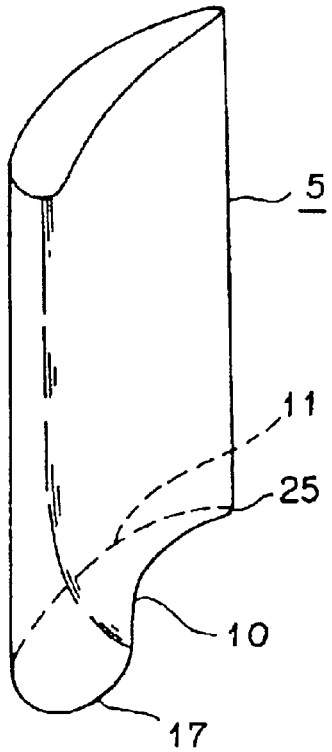
FIG. 8 is a perspective view of the moving blade of the same.

FIG. 7 and FIG. 8 are explanatory diagrams showing a sixth embodiment of a blade structure in a gas turbine relating to this invention. In the drawings, reference numbers that are the same as those in FIG. 1 to FIG. 6 and FIG. 16 to FIG. 19 show the identical portions.

A blade structure in a sixth embodiment relates to a moving blade 5 like a free-standing moving blade and a shrouded moving blade. A front-edge including angle θs1 at a hub portion (a cross section of a hub portion) of this moving blade 5 is made larger than a front-edge including angle of portions (a cross section of a tip portion to a mean portion) other than the hub portion of this moving blade 5. For example, this is made larger than about 5°.

Further, an entrance metal angle βs1 of a hub portion (a cross section of a hub portion) of this moving blade 5 is made smaller than an entrance metal angle of portions (a cross section of a tip portion to a mean portion) other than the hub portion of this moving blade 5. In other words, the entrance metal angle βs1 of the cross section of the hub portion of the moving blade 5 is directed toward a rear surface 11 side by about 10°, for example, as compared with the entrance metal angle of the cross section of the tip portion to the mean portion.

According to the blade structure of this sixth embodiment, the front-edge including angle θs1 is taken large at the hub portion of this moving blade 5. With this arrangement, a curve of a relative relationship between the incidence angle and the pressure loss becomes mild as shown by the broken-line curve in FIG. 18. As a result, it is possible to make the pressure loss small as shown by the point P3 in FIG. 18. Therefore, it becomes possible to improve the turbine efficiency.

Further, according to the blade structure of this sixth embodiment, the entrance metal angle βs1 is taken small at the hub portion of the moving blade 5. With this arrangement, it is possible to make an incidence angle is1 small as shown by the point P4 in FIG. 18. As a result, it is possible to make the pressure loss small. Therefore, it becomes possible to improve the turbine efficiency.

Particularly, according to the blade structure of this sixth embodiment, it is possible to make the pressure loss much smaller, based on a synergy effect of the work that a curve of a relative relationship between the incidence angle and the pressure loss becomes mild as shown by the broken-line curve in FIG. 18 and the work that the incidence angle is1 can be made small as shown by the point P5 in FIG. 18. As a result, it becomes possible to improve the turbine efficiency.

Figure 9:
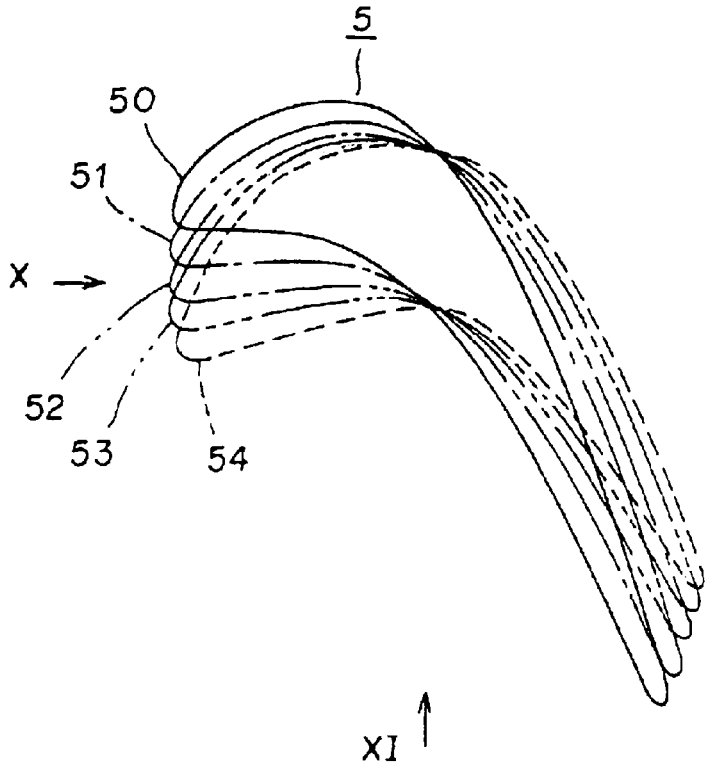
FIG. 9 is an explanatory diagram of a cross section of a stacking shape of a moving blade showing a seventh embodiment of a blade structure in a gas turbine according to this invention.
Figure 12A:
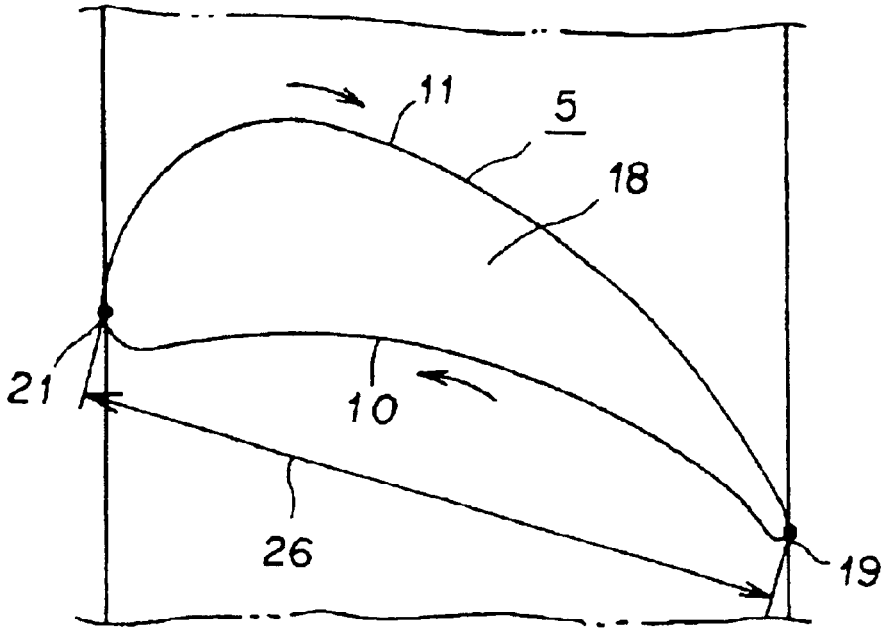
FIG. 12A is an explanatory diagram of a cross section of a hub portion of a moving blade showing a chord length.

FIG. 9 and FIG. 12 are explanatory diagrams showing a seventh embodiment of a blade structure in a gas turbine relating to this invention. In the drawings, reference numbers that are the same as those in FIG. 1 to FIG. 8 and FIG. 16 to FIG. 19 show the identical portions.

A blade structure in a seventh embodiment relates to a moving blade 5 like a free-standing moving blade and a shrouded moving blade. A chord length 26 at a tip portion 18 (a cross section of the tip portion 18) of this moving blade 5 is made larger than a minimum chord length at other portions (a cross section of a hub portion to a mean section) than the tip portion of the moving blade 5. In other words, the chord length 26 of the cross section of the tip portion 18 is made equal to or larger than the chord length of the mean cross section (a ratio of pitch to chord is set larger than a conventional ratio).

Figure 10:
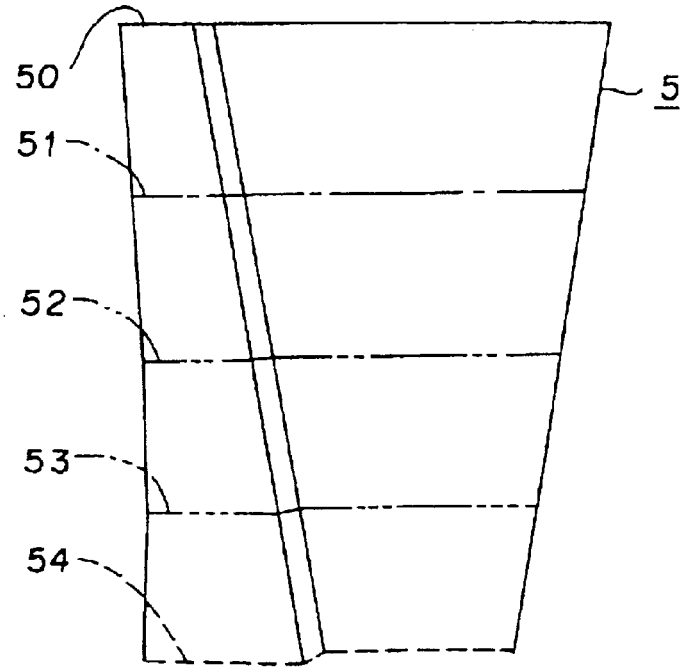
FIG. 10 is a diagram of FIG. 9 viewed from a direction of X.
Figure 11:
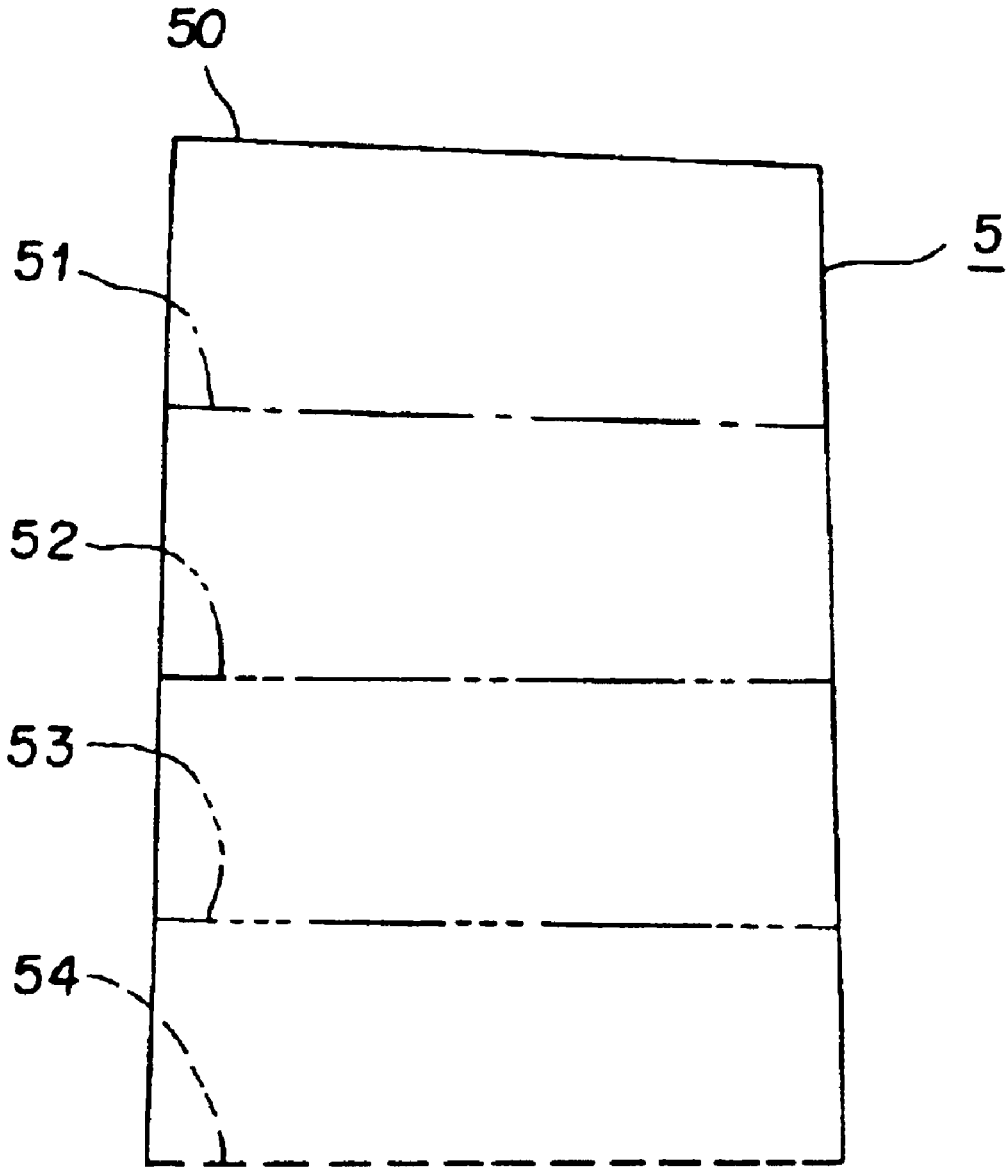
FIG. 11 is a diagram of FIG. 9 viewed from a direction of XI.

FIG. 9 is an explanatory diagram of a cross section showing a stacking shape of the moving blade 5. In FIG. 9 to FIG. 11, a stacking shape shown by a reference number 50 and a solid line show a tip. A stacking shape shown by a reference number 51 and a one-dot chained line show a tip at a position of about 75% of the height from a hub. Further, a stacking shape shown by a reference number 52 and a two-dot chained line show a mean. Further, a stacking shape shown by a reference number 53 and a three-dot chained line show a tip at a position of about 25% of the height from the hub. Last, a stacking shape shown by a reference number 54 and a broken line show the hub.

Figure 12B:
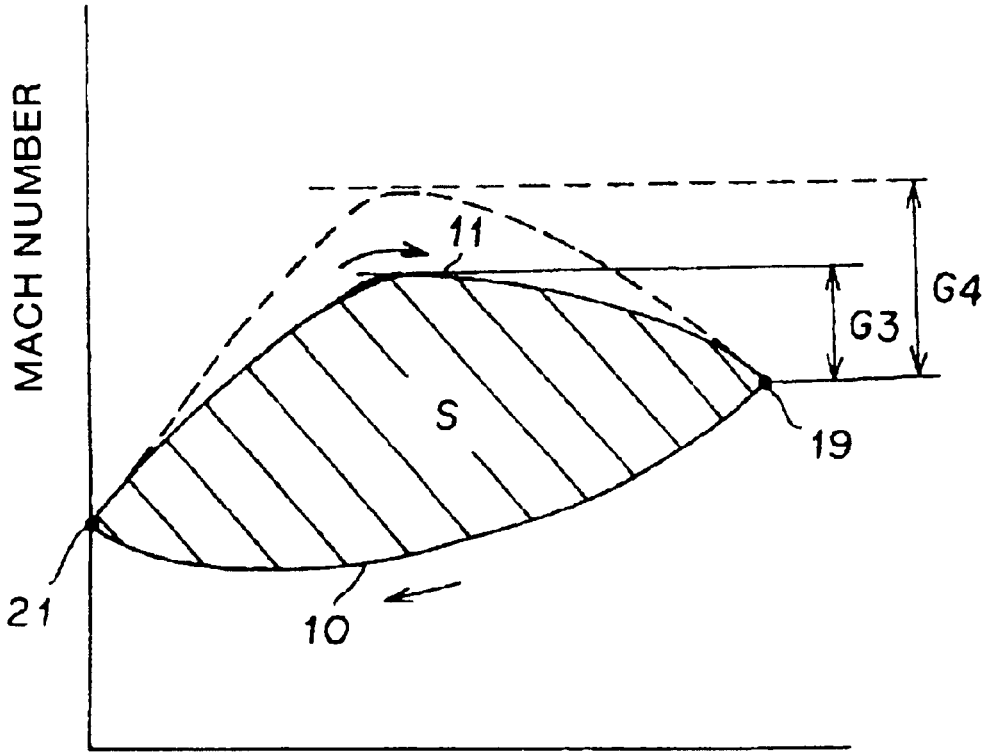
FIG. 12B is an explanatory diagram of a Mach number distribution according the moving blade shown in FIG. 12A.

According to the blade structure of this sixth embodiment, it is possible to make small the deceleration from an intermediate portion to a rear edge 19 on a rear surface 11 of a tip portion 18 of a moving blade 5, as shown by G4 in FIG. 12B, by making large a chord length 26 of the tip portion 18 of the moving blade 5.

Figure 19A:
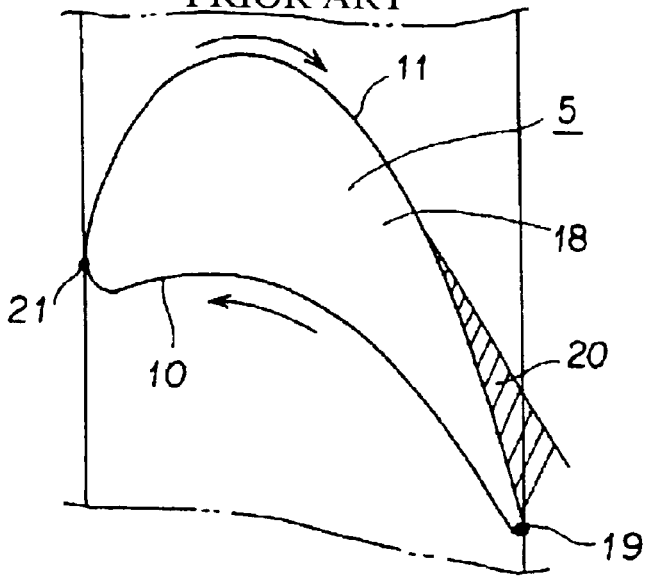
FIG.19A PRIOR ART
FIG. 19A is an explanatory diagram of a cross section of a hub portion of a moving blade showing a conventional blade structure.
Figure 19B:
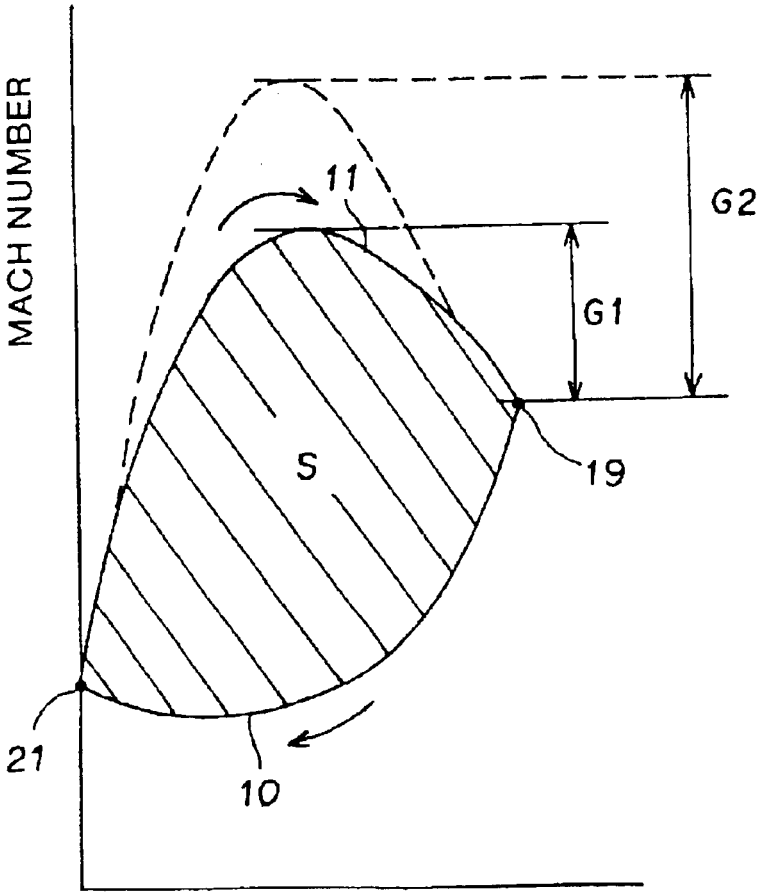
FIG. 19B is an explanatory diagram of a Mach number distribution according to the moving blade shown in FIG. 19A.

Namely, in Mach number distributions in FIG. 12B and FIG. 19B, an area of a portion encircled by a solid-line curve (an area of a portion provided with shaded lines, and a pressure difference) S is constant. In this case, when the chord length 26 of the tip portion 18 of the moving blade 5 is made large, the area S of the Mach number distribution changes from a vertically-long shape shown in FIG. 19B to a laterally-long shape shown in FIG. 12B. As a result, the deceleration changes from G2 shown in FIG. 19B to small G4 shown in FIG. 12B. Consequently, it is possible to restrict the swelling of the boundary layer. Therefore, it is possible to make the pressure loss small, and it becomes possible to improve the turbine efficiency by that amount.

Figure 13:
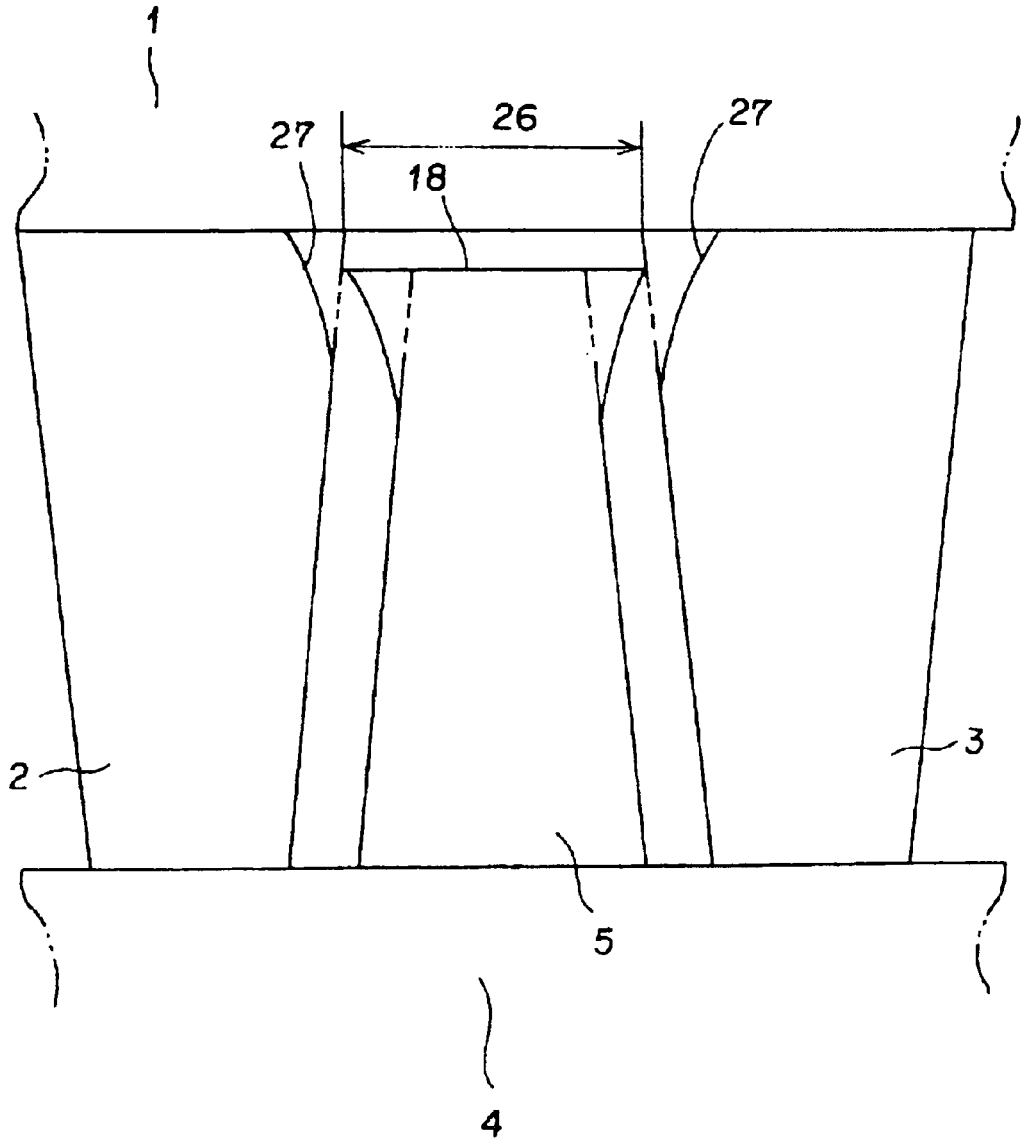
FIG. 13 is an explanatory diagram showing a modification of the seventh embodiment of a blade structure in a gas turbine according to this invention.

FIG. 13 to FIG. 15 show modifications of a blade structure in a gas turbine relating to this invention. In these drawings, reference numbers that are the same as those in FIG. 1 to FIG. 12 and FIG. 16 to FIG. 19 show the identical portions.

First, a modification shown in FIG. 13 is a modification of the seventh embodiment. Tip portions of stationary blades 2 and 3 are provided with escape sections 27 for avoiding an interference with a tip portion 18 of a moving blade 5.

According to this seventh embodiment, there is no room for mutual interference between the tip portion 18 of the moving blade 5 and the tip portions of the stationary blades 2 and 3 adjacent to each other, even when the chord length 26 of the tip portion 18 of the moving blade 5 is made large. A two-dot chained line in FIG. 13 shows a conventional blade structure.

Figure 14A:
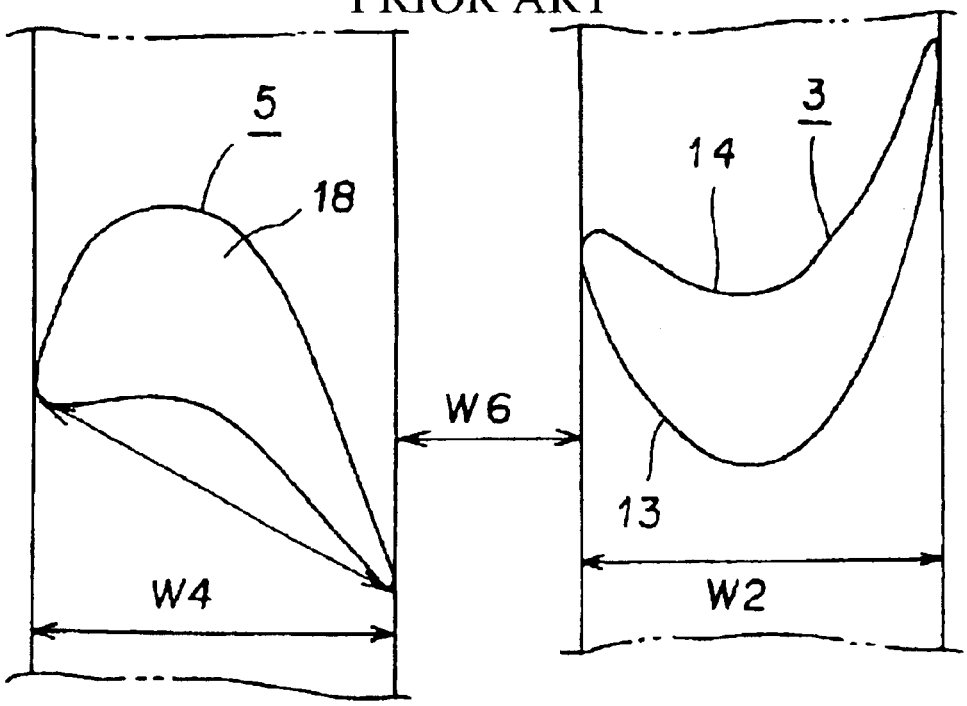
FIG.14A PRIOR ART
FIG. 14A is an explanatory diagram of a cross section of a moving blade and a stationary blade showing a conventional blade structure.
Figure 14B:
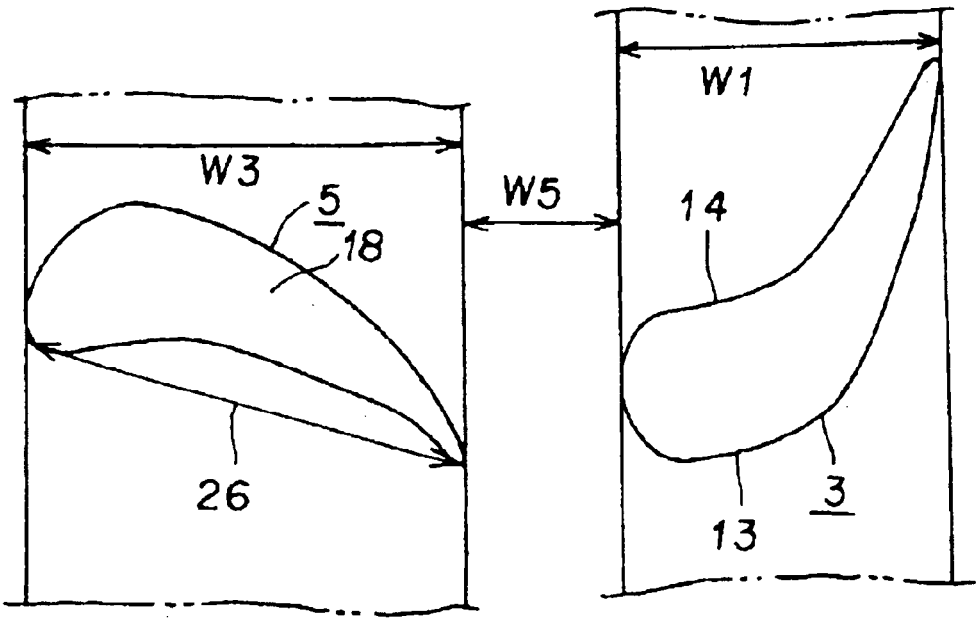
FIG. 14B is an explanatory diagram of a cross section of a moving blade and a stationary blade showing a modification of the seventh embodiment of a blade structure in a gas turbine according to this invention.

Next, a modification shown in FIG. 14B is a modification of the seventh embodiment. As an escape section of the tip portion of the stationary blade 3, the entrance metal angle βc1 of the tip portion of the stationary blade 3 is made smaller than the entrance metal angle of portions (the hub portion to the mean portion) other than the tip portion of the stationary blade 3. In other words, as shown in FIG. 2, FIG. 3 and FIG. 4, the entrance metal angle βc1 of the tip portion of the stationary blade 3 is directed toward the rear surface 13 side of the stationary blade 3. It is also possible to have a similar structure for the stationary blade 2 at the same stage as that of the moving blade 5.

According to the modification shown in this FIG. 14B, as the entrance metal angle βc1 of the tip portion of the stationary blade 3 is directed toward the rear surface 13 side of the stationary blade 3, it is possible to have a width W1 in an axial direction of the stationary blade 3 smaller than a width W2 of a conventional moving blade shown in FIG. 14A. As a result, even when a width W3 in the axial direction of the moving blade 5 is made larger than a conventional width W4 by increasing the chord length 26 of the tip portion 18 of the moving blade 5, a width W5 from the moving blade 5 to the stationary blade 3 makes little change from a conventional width W6. Therefore, there is no room for mutual interference between the tip portion 18 of the moving blade 5 and the tip portion of the stationary blade 3 adjacent to each other, even when the chord length 26 of the tip portion 18 of the moving blade 5 is made large.

Further, according to the modification shown in this FIG. 14B, as the entrance metal angle βc1 of the tip portion of the stationary blade 3 is smaller than the entrance metal angle of the hub portion to the mean portion other than the tip portion of the stationary blade 3, it becomes possible to make the incidence angle βc1 small as shown by the point P4 in FIG. 18. As it is possible to make the pressure loss smaller by that amount, it becomes possible to improve the turbine efficiency.

Figure 15A:
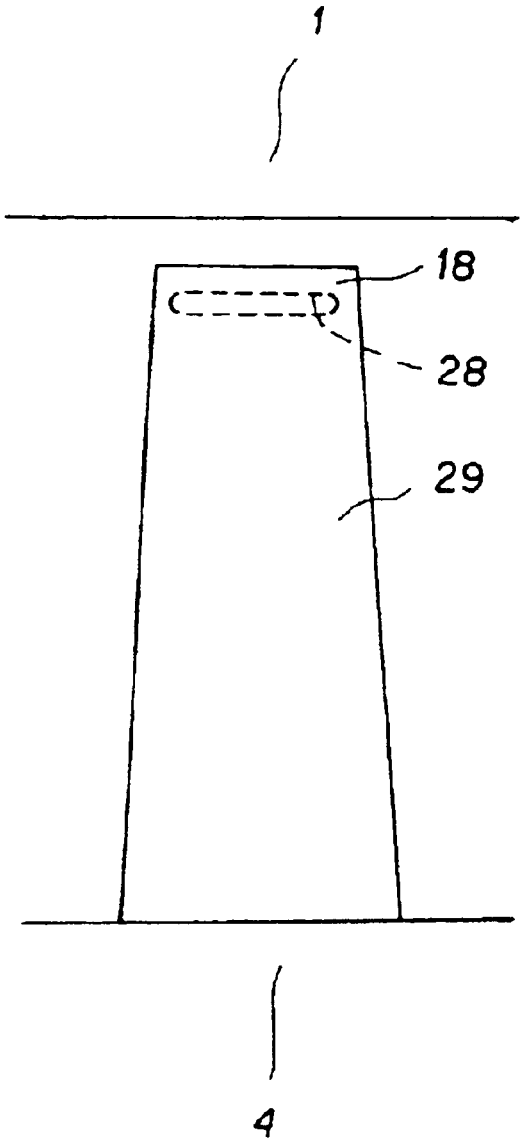
FIG. 15A is an explanatory diagram of a cooling moving blade showing a modification of the seventh embodiment of a blade structure in a gas turbine according to this invention.
Figure 15B:
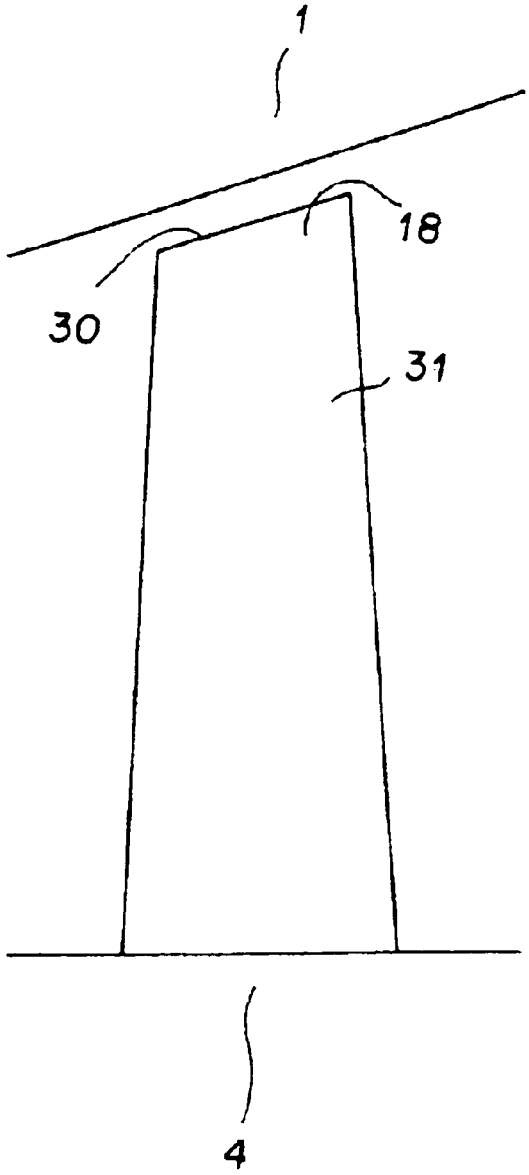
FIG. 15B is an explanatory diagram of a moving blade having a taper according to the same.
Figure 16:
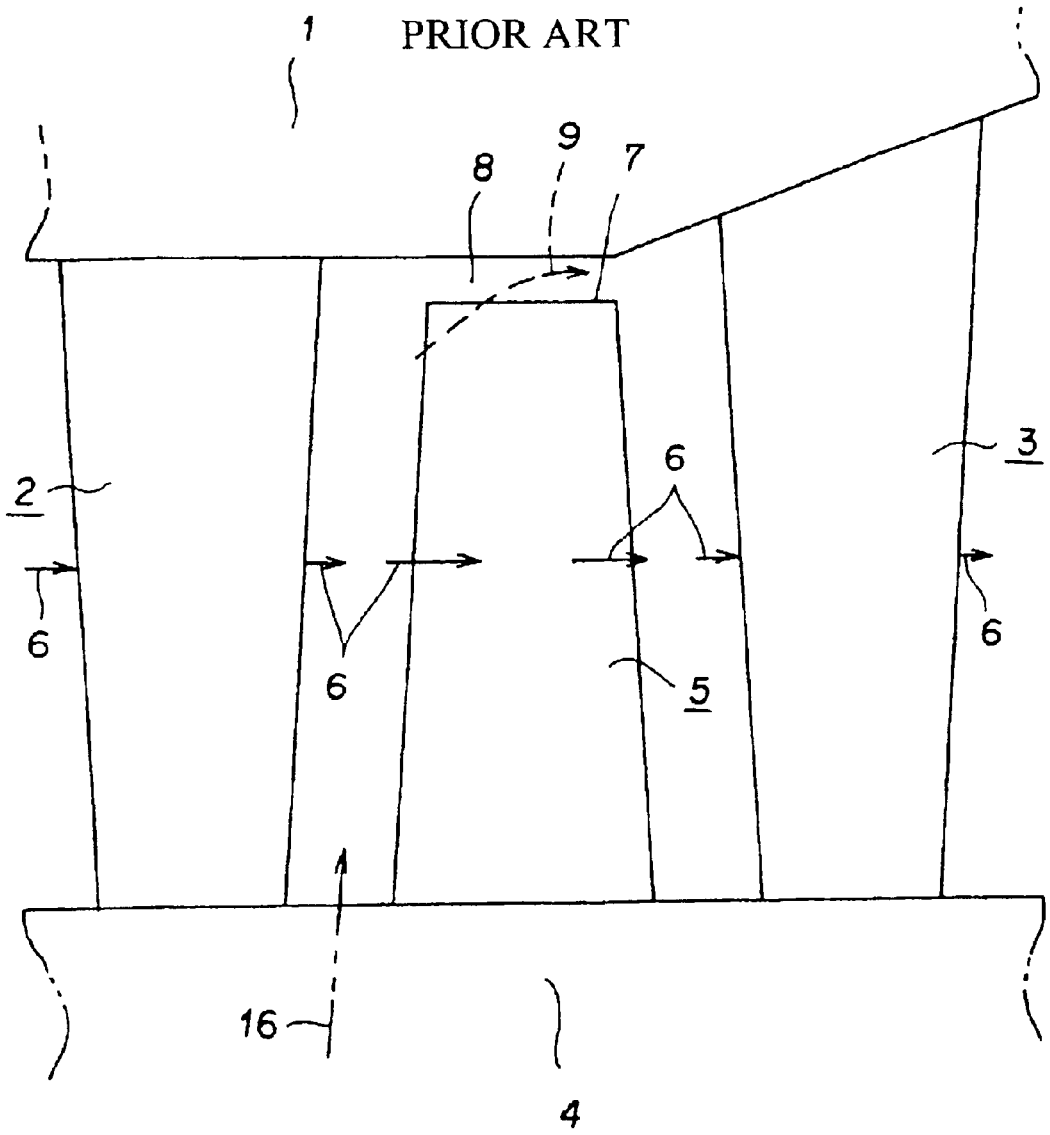
FIG.16 PRIOR ART
FIG. 16 is an explanatory diagram of a moving blade and a stationary blade showing a conventional blade structure.
Figure 17:
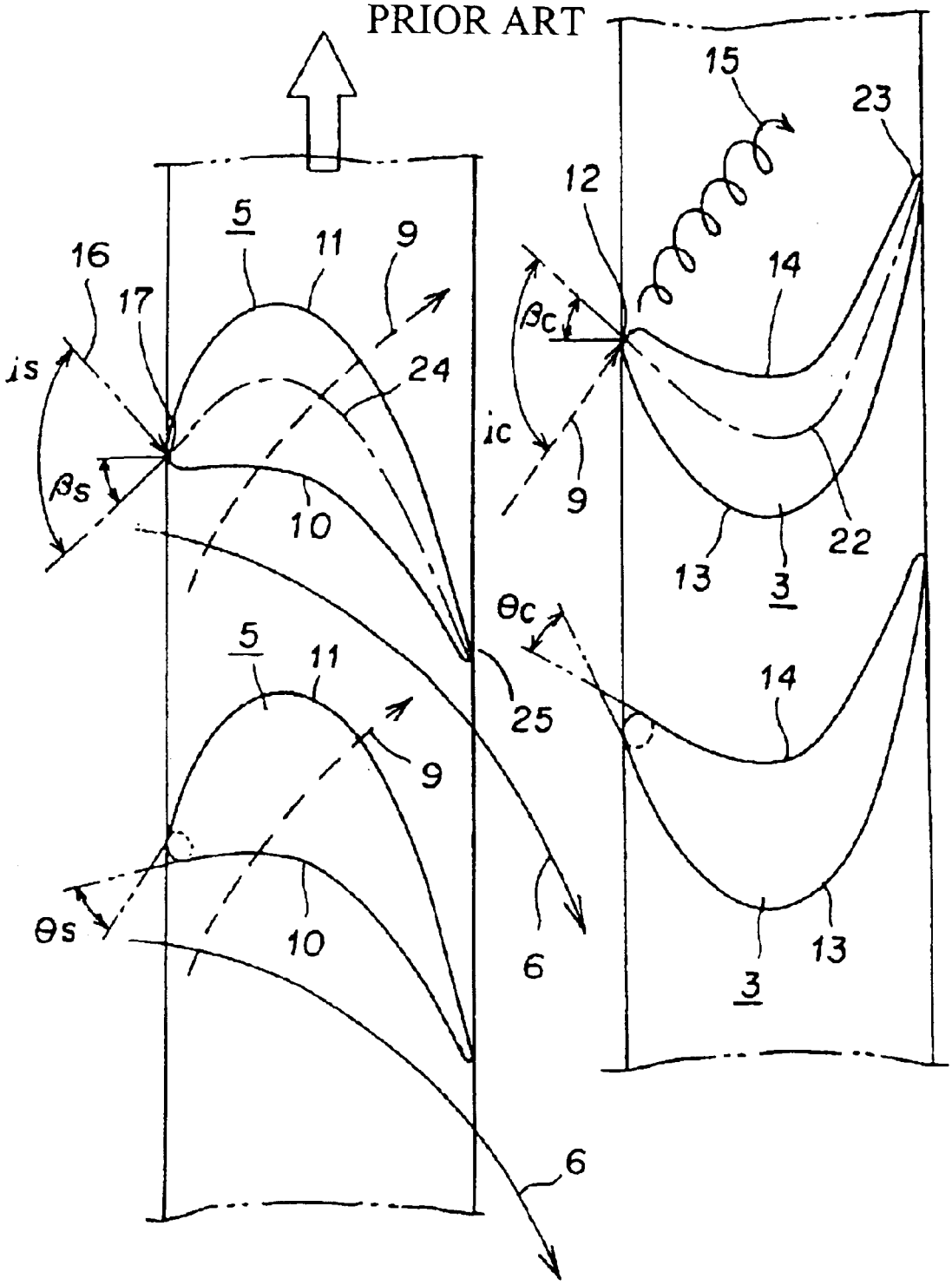
FIG.17 PRIOR ART
FIG. 17 is an explanatory diagram of a cross section of a moving blade and a stationary blade showing a conventional blade structure.

Then, the blade structure relating to this invention can also be applied to a cooling moving blade 29 having a hollow portion 28 at the tip portion 18, as shown in FIG. 15A. Further, it is also possible to apply the blade structure relating to this invention to a moving blade 31 of which tip portion 18 has a taper 30 along the taper of the casing 1, as shown in FIG. 15B.

As is clear from the above, according to the blade structure in a gas turbine relating to one aspect of this invention, a front-edge including angle is taken large, at a tip portion of a stationary blade at a rear stage of a moving blade having a tip clearance. Therefore, a curve of a relative relationship between the incidence angle and the pressure loss becomes mild. As it is possible to reduce the pressure loss by that amount, it becomes possible to improve the turbine efficiency.

According to the blade structure in a gas turbine relating to another aspect of this invention, it is possible to make an incidence angle small by making an entrance metal angle small, at a tip portion of a stationary blade at a rear stage of a moving blade having a clearance. As it is possible to reduce the pressure loss by that amount, it becomes possible to improve the turbine efficiency.

According to the blade structure in a gas turbine relating to still another aspect of this invention, a front-edge including angle is taken large at a tip portion of a stationary blade, at a rear stage of a moving blade having a tip clearance. Therefore, a curve of a relative relationship between an incidence angle and a pressure loss becomes mild. As it is possible to reduce the pressure loss by that amount, it becomes possible to improve the turbine efficiency.

According to the blade structure in a gas turbine relating to still another aspect of this invention, it is possible to make an incidence angle small by making an entrance metal angle small, at a tip portion of a stationary blade at a rear stage of a moving blade having a clearance. As it is possible to reduce the pressure loss by that amount, it becomes possible to improve the turbine efficiency.

According to the blade structure in a gas turbine relating to still another aspect of this invention, it is possible to make the pressure loss much smaller based on a synergy effect of the work that a curve of a relative relationship between an incidence angle and a pressure loss becomes mild and the work that the incidence angle can be made small. As a result, it becomes possible to improve the turbine efficiency.

According to the blade structure in a gas turbine relating to still another aspect of this invention, a curve of a relative relationship between an incidence angle and a pressure loss becomes mild by making a front-edge including angle large at a hub portion of a moving blade. As it is possible to reduce the pressure loss by that amount, it becomes possible to improve the turbine efficiency.

According to the blade structure in a gas turbine relating to still another aspect of this invention, it is possible to make an incidence angle small by making an entrance metal angle small at a hub portion of a moving blade. As it is possible to reduce the pressure loss by that amount, it becomes possible to improve the turbine efficiency.

According to the blade structure in a gas turbine relating to still another aspect of this invention, a curve of a relative relationship between an incidence angle and a pressure loss becomes mild by making a front-edge including angle large at a hub portion of a moving blade. As it is possible to reduce the pressure loss by that amount, it becomes possible to improve the turbine efficiency.

According to the blade structure in a gas turbine relating to still another aspect of this invention, it is possible to make an incidence angle small by making an entrance metal angle small at a hub portion of a moving blade. As it is possible to reduce the pressure loss by that amount, it becomes possible to improve the turbine efficiency.

According to the blade structure in a gas turbine relating to still another aspect of this invention, it is possible to make the pressure loss much smaller based on a synergy effect of the work that a curve of a relative relationship between an incidence angle and a pressure loss becomes mild and the work that the incidence angle can be made small. As a result, it becomes possible to improve the turbine efficiency.

According to the blade structure in a gas turbine relating to still another aspect of this invention, it is possible to make small the deceleration from an intermediate portion to a rear edge on a rear surface of a tip portion of a moving blade by making a chord length of the moving blade large. Then, it is possible to minimize the swelling of the boundary layer. As a result, it is possible to make the pressure loss small, and it becomes possible to improve the turbine efficiency by that amount.

Furthermore, a tip portion of a stationary blade is provided with an escape section for avoiding an interference with a tip portion of a moving blade. As a result, there is no room for mutual interference between a tip portion of the moving blade and tip portions of stationary blades adjacent to each other, even when a chord length of the tip portion of the moving blade is made large.

Moreover, as an entrance metal angle at a tip portion of a stationary blade is directed toward the rear surface side of the stationary blade, there is no room for mutual interference between a tip portion of a moving blade and tip portions of stationary blades adjacent to each other, even when the chord length of the tip portion of the moving blade is made large.

Furthermore, as an entrance metal angle at a tip portion of a stationary blade is smaller than an entrance metal angle at other portions than the tip portion of the stationary blade, it is possible to make an incidence angle small. As it is possible to reduce the pressure loss by that amount, it becomes possible to improve the turbine efficiency.

Although the invention has been described with respect to a specific embodiment for a complete and clear disclosure, the appended claims are not to be thus limited but are to be constructed as embodying all modifications and alternative constructions that may occur to one skilled in the art which fairly fall within the basic teaching herein set forth.

What is claimed is:

1. A blade structure in a gas turbine, comprising:

stationary blades arrayed in a circle on a casing;

moving blades arrayed in a circle on a rotor, wherein a clearance is provided between tips of the moving blades and the casing, wherein an entrance metal angle at a tip portion of the stationary blade that is the stationary blade at a rear stage of the moving blade having the tip clearance is smaller than an entrance metal angle at other portions than the tip portion of the stationary blade.

2. A blade structure in a gas turbine, comprising:

stationary blades arrayed in a circle on a casing;

moving blades arrayed in a circle on a rotor, wherein a clearance is provided between tips of the moving blades and the casing, wherein a front-edge including angle at a tip portion of the stationary blade that is the stationary blade at a rear stage of the moving blade having the tip clearance is larger than a front-edge including angle at other portions than the tip portion of the stationary blade, and also an entrance metal angle at a tip portion of the stationary blade is smaller than an entrance metal angle at other portions than the tip portion of the stationary blade.

* * * * *